US008960824B2

(12) United States Patent
Wilcox et al.

(10) Patent No.: US 8,960,824 B2
(45) Date of Patent: Feb. 24, 2015

(54) CUSTOMIZABLE DRAWER LINER FOR A REFRIGERATOR DRAWER

(71) Applicant: Whirlpool Corporation, Benton Harbor, MI (US)

(72) Inventors: Michele E. Wilcox, Stevensville, MI (US); Douglas D. LeClear, Coloma, MI (US); Karen J. Querfurth, Coloma, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 117 days.

(21) Appl. No.: 13/835,836

(22) Filed: Mar. 15, 2013

(65) Prior Publication Data

US 2014/0265802 A1 Sep. 18, 2014

(51) Int. Cl.
*A47B 88/20* (2006.01)
*F25D 25/02* (2006.01)

(52) U.S. Cl.
CPC ..... *F25D 25/025* (2013.01)
USPC ..... 312/404; 312/348.3; 62/382

(58) Field of Classification Search
CPC ..... A47B 88/20; A47B 2088/20; A47B 2088/202; F25D 23/12; B65D 25/04; B65D 25/06
USPC ..... 312/401, 402, 404, 410, 348.3; 220/528, 529, 540, 542, 544; 62/382, 62/441
See application file for complete search history.

(56) References Cited

U.S. PATENT DOCUMENTS

| | | | | |
|---|---|---|---|---|
| 2,427,048 | A | 10/1943 | Ganzer | |
| 3,117,688 | A * | 1/1964 | Walstad et al. | 217/7 |
| 3,550,979 | A * | 12/1970 | Protzmann | 312/183 |
| 3,868,021 | A | 2/1975 | Heinrich | |
| 4,305,217 | A * | 12/1981 | Green et al. | 40/374 |
| 4,909,384 | A | 3/1990 | About | |
| 6,886,693 | B1 * | 5/2005 | Davenport et al. | 206/494 |
| D513,270 | S | 12/2005 | Seok et al. | |
| 6,974,041 | B2 | 12/2005 | Salemi | |
| 7,490,915 | B2 | 2/2009 | O'Halloran et al. | |
| 7,874,176 | B2 | 1/2011 | Uihlein et al. | |
| 8,733,867 | B2 * | 5/2014 | Hwang et al. | 312/402 |
| 2006/0250062 | A1 * | 11/2006 | Janda et al. | 312/402 |
| 2006/0260353 | A1 * | 11/2006 | Uihlein et al. | 62/441 |
| 2008/0302125 | A1 | 12/2008 | Cushman et al. | |
| 2009/0230832 | A1 | 9/2009 | Shin | |
| 2010/0218514 | A1 | 9/2010 | Bertolini et al. | |
| 2010/0319391 | A1 * | 12/2010 | Lim et al. | 62/441 |
| 2012/0146480 | A1 | 6/2012 | Yochum et al. | |
| 2012/0181910 | A1 | 7/2012 | Kim et al. | |

FOREIGN PATENT DOCUMENTS

| | | | |
|---|---|---|---|
| CN | 2881480 | Y | 3/2007 |
| CN | 202092406 | U | 12/2011 |

(Continued)

*Primary Examiner* — James O Hansen

(57) ABSTRACT

A refrigerator drawer liner for segregating a plurality of storage objects in a refrigerator drawer and for transporting storage objects between a secondary location and the refrigerator drawer, the refrigerator drawer liner having a container body having a receiving space for receiving at least one storage object, a container bottom, at least two side walls, and a positioning slot. The refrigerator drawer liner may have at least one separation plate for variably dividing the receiving space of the container body. The at least one separation plate may have a position adjusting handle operatively connected to the at least one separation plate through the positioning slot.

16 Claims, 14 Drawing Sheets

(56) References Cited

FOREIGN PATENT DOCUMENTS

| | | | |
|---|---|---|---|
| CN | 202254610 | U | 5/2012 |
| DE | 3214159 | A1 | 10/1983 |
| JP | 2011064444 | A | 3/2011 |
| KR | 2010018235 | A | 2/2010 |
| KR | 2012071634 | A | 7/2012 |
| WO | 2007033969 | A1 | 3/2007 |
| WO | 2011160973 | A1 | 12/2011 |

* cited by examiner

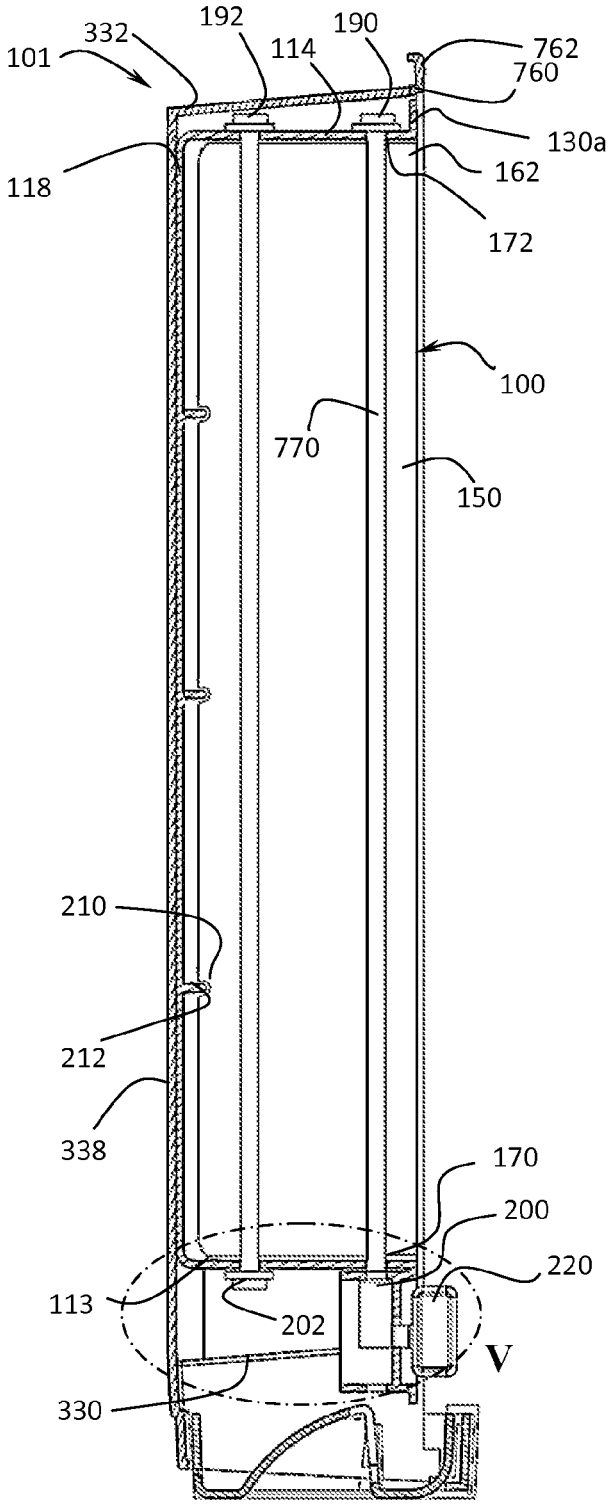
FIG. 7A (Section II-II)

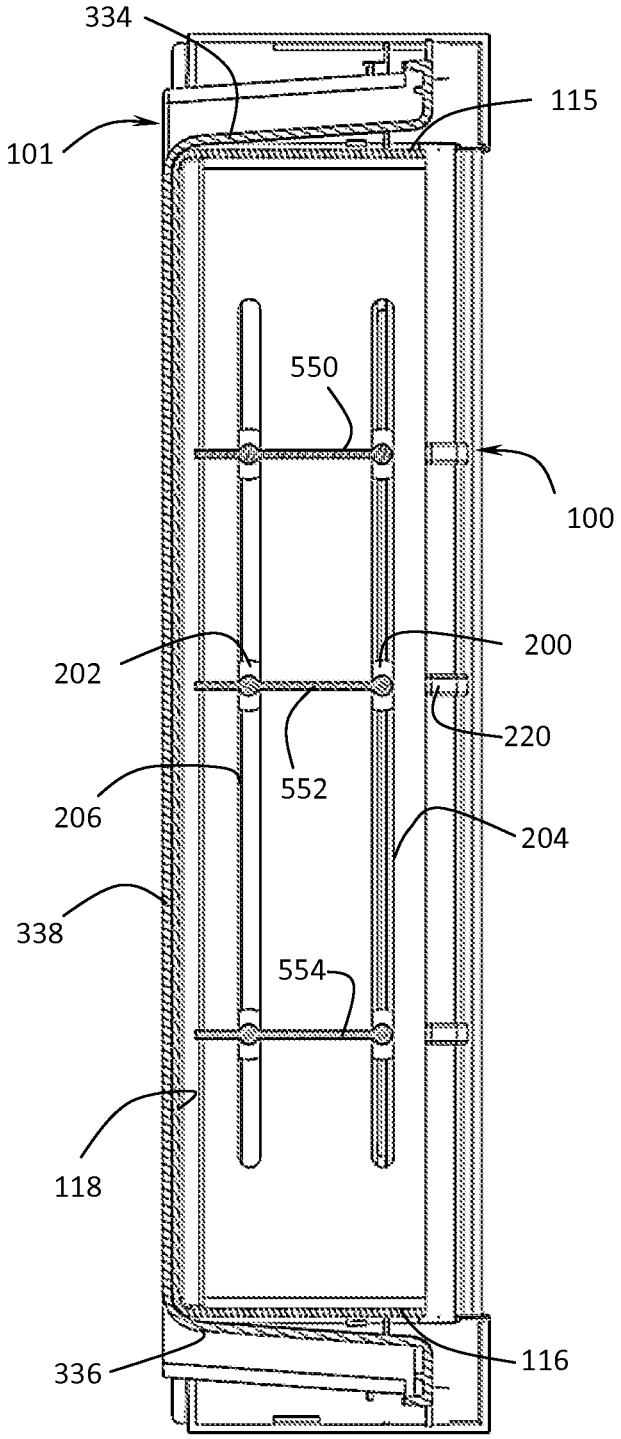
FIG. 7B (Section III-III)

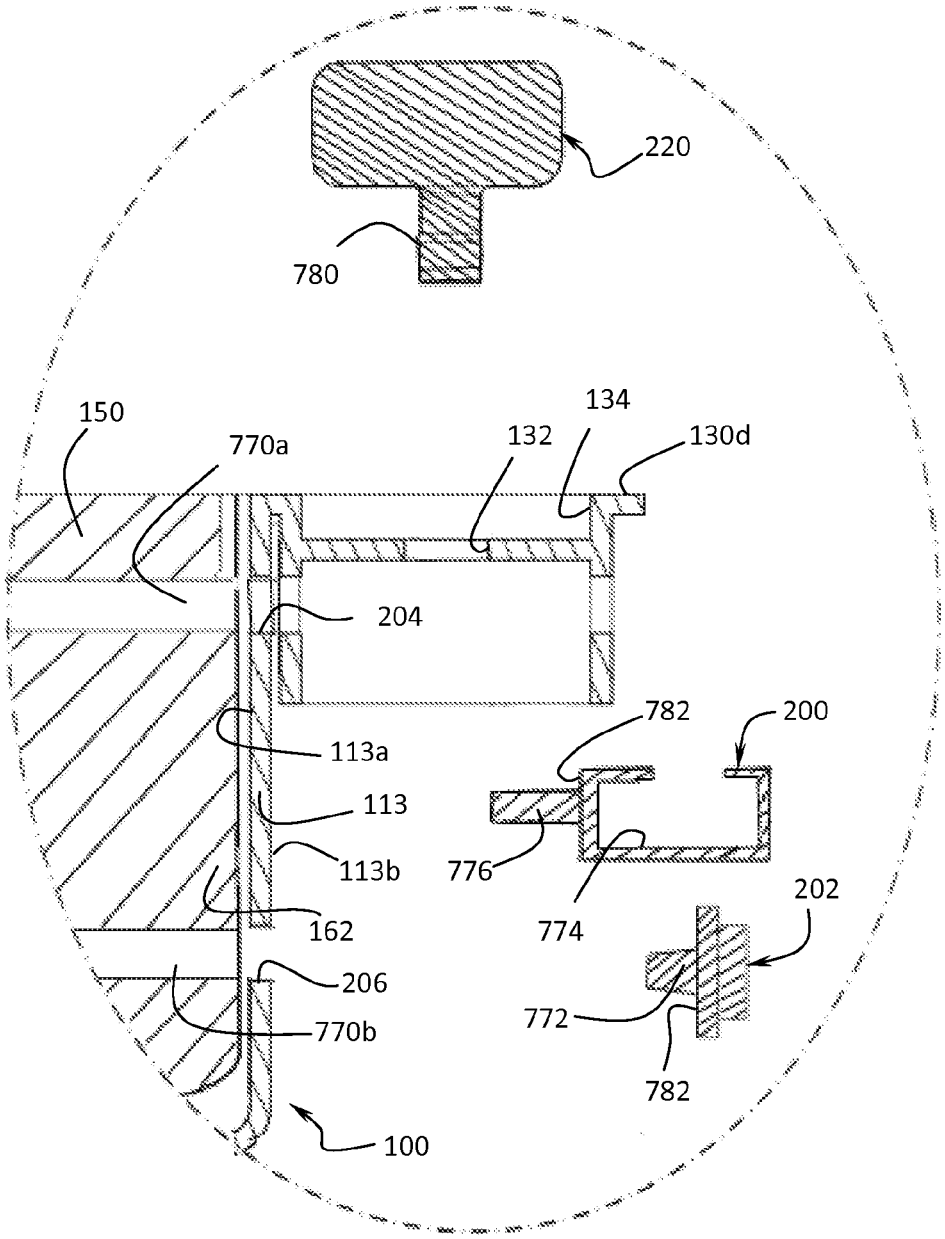
FIG. 8A (SECTION IV-IV AREA V)

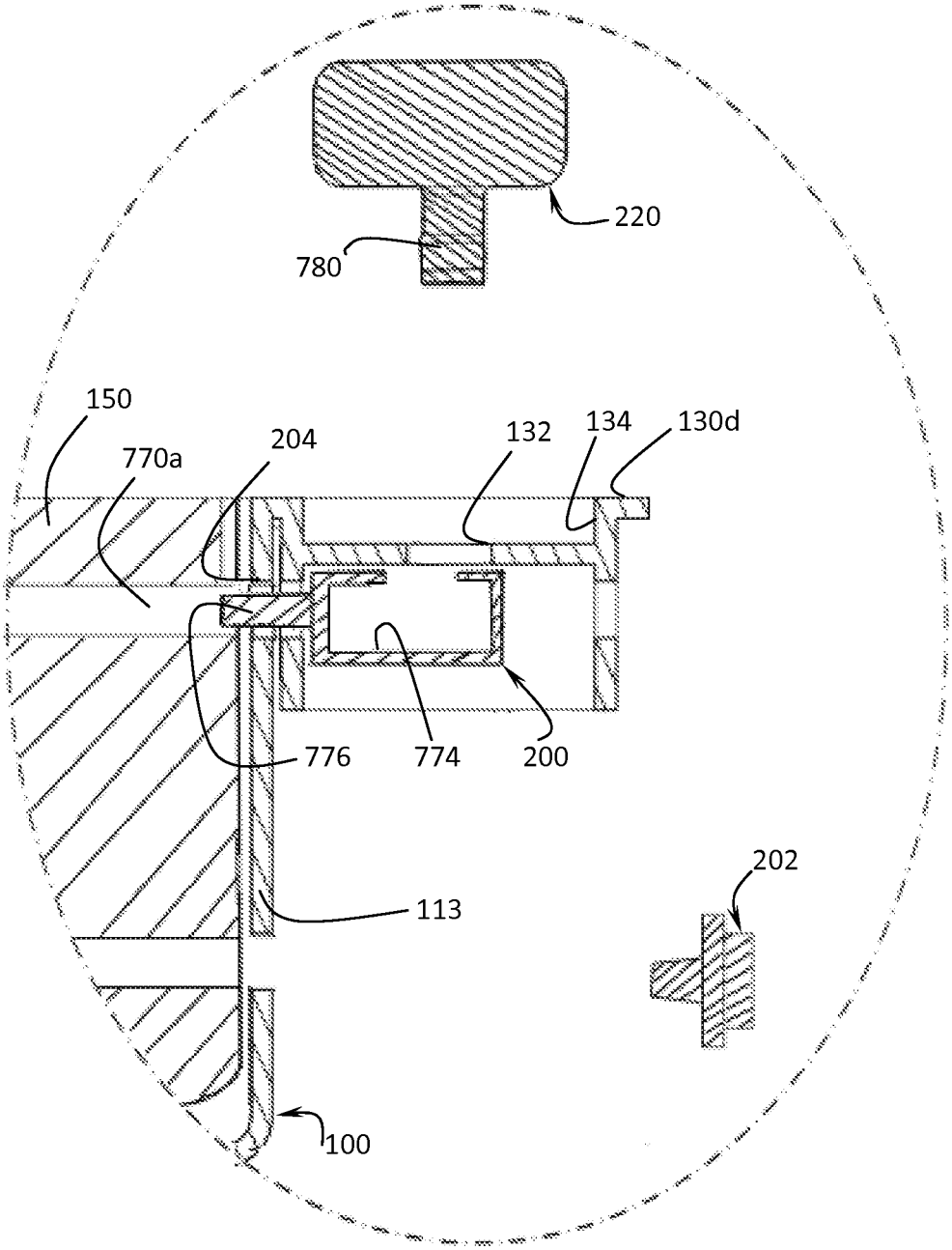
FIG. 8B (SECTION IV-IV AREA V)

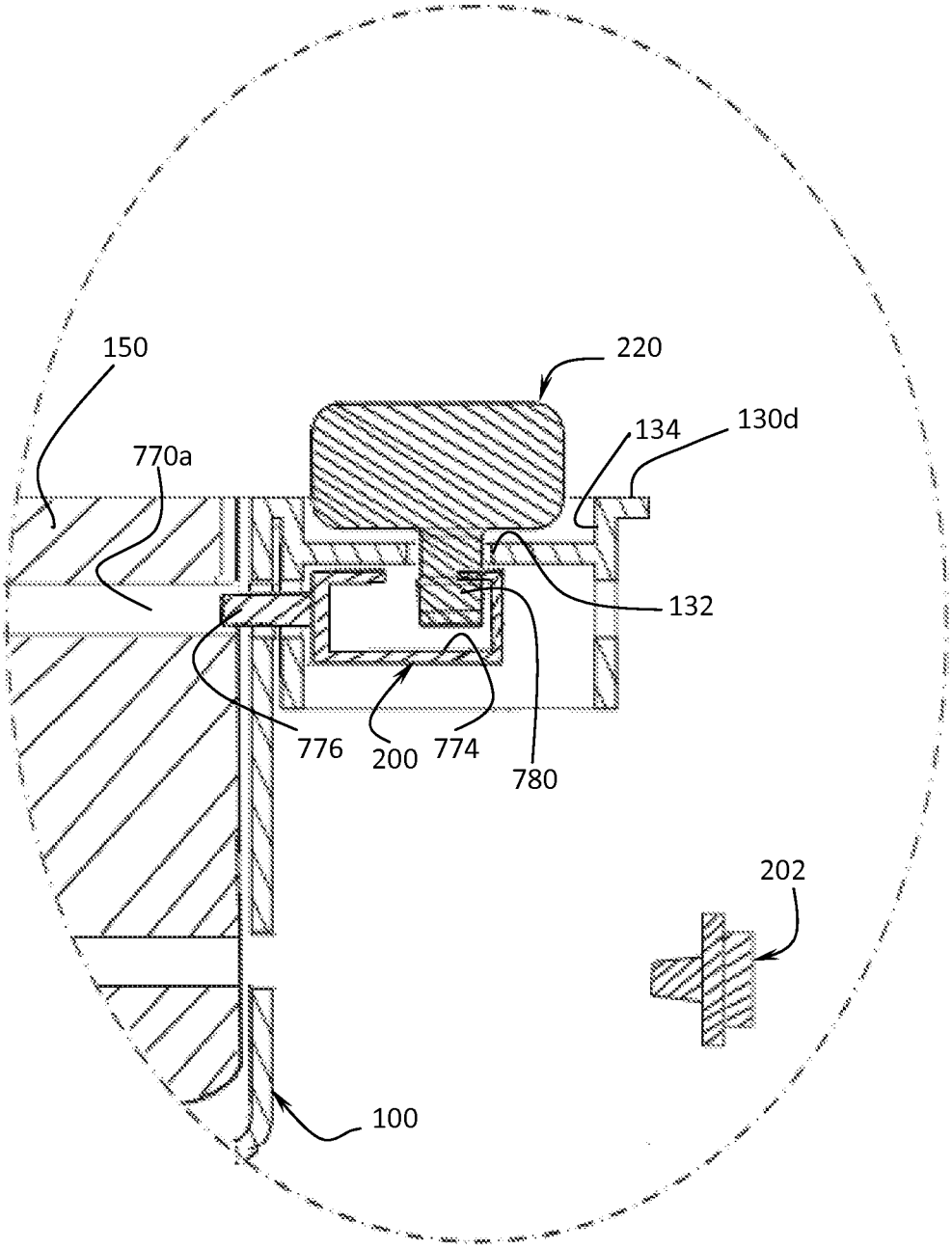
FIG. 8C (SECTION IV-IV AREA V)

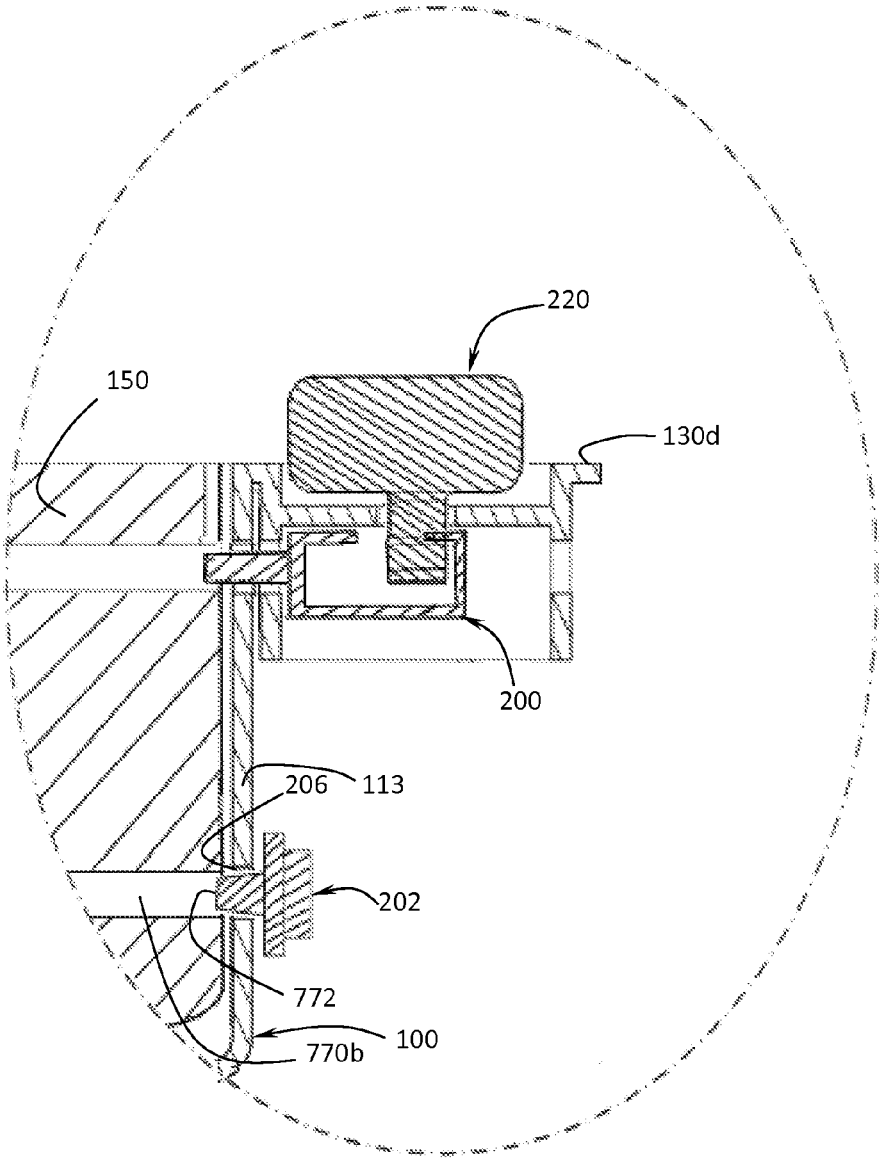
FIG. 8D (SECTION IV-IV AREA V)

CUSTOMIZABLE DRAWER LINER FOR A REFRIGERATOR DRAWER

FIELD OF THE INVENTION

The present invention relates generally to a refrigerator drawer liner having one or more repositionable separation plates.

BACKGROUND OF THE INVENTION

When small items are stored in a refrigerator drawer, particularly in a wide refrigerator drawer, the items may move around in the drawer when the drawer is moved between a storage position and an accessible position. The small items may become disorganized in the drawer due to the drawer movement.

A drawer with a repositionable divider allows a user to customize the space in the drawer to hold specific sized items. A drawer with an integrated divider limits the user to using the divider in the drawer. The divider reduces the usable space in the drawer due to the volume of the divider. When the divider is integrated into the drawer, the user is restricted to only storing small items in the drawer. The user does not have the option of removing a divider to store larger items in the drawer.

A drawer with a removable divider may result in the user misplacing the divider when it is removed from the drawer. In some cases, a removable divider may be undesirable if the divider contains small parts or if the user has to store the dividers.

A user may have a refrigerator with a drawer in which the user desires to store small items in an organized way. A divided drawer may not be available to fit in an existing refrigerator. Small containers may be placed in a drawer to sub-divide the drawer. These containers may be inadequate since the containers may not fit neatly in a drawer, may not efficiently sub-divide the space, and may slide around in the drawer when the drawer is repositioned.

When loading many small items into a refrigerator, a user may only be able to carry a few items to the refrigerator at a time to load items into the drawer. When a user has many small items, a number of trips to the refrigerator may be required for the user to place all the items in the drawer. The user may leave the refrigerator door open for an extended time in order to place items in the drawer. As well as being inconvenient for the user, leaving the refrigerator door open during the time required to load items into the drawer increases the energy consumption of the refrigerator and may result in a temperature rise in the refrigerator.

The present invention relates to a customizable drawer liner for a refrigerator drawer, in particular to a removable drawer liner that also may be used outside of the refrigerator. This customized drawer liner is a solution to the problems of neatly storing small items in a refrigerator drawer, of adding a drawer liner to an existing refrigerator drawer, and having a removable drawer liner.

BRIEF SUMMARY OF THE INVENTION

One aspect of the present invention is a refrigerator drawer liner with integrated dividers suitable for placement in a refrigerator drawer. When the user desires to use the drawer liner, the liner may be placed into the drawer. When the user desires to use the full width of the drawer, the drawer liner may be removed.

Another aspect of the present invention is a refrigerator drawer liner including at least one movable divider. The movable divider may be adjusted based on the size of the items to be placed in the drawer. The divider may prevent the items from moving around in the drawer when the drawer is repositioned.

Another aspect of the present invention is the drawer liner being removable from the drawer for use in a second location. The liner may be carried by the user to a location suitable for loading items into the drawer liner or removing items from the drawer liner. The drawer liner has handles attached to the movable dividers. The handles permit the user to adjust the location of the dividers. The handles may function as grab points for the user to remove the drawer liner from the drawer.

Another aspect of the present invention is a refrigerator drawer liner designed to store a specific type of item such as fruit, vegetables, juice boxes, single serving items, and the like. A drawer liner for fruit or vegetables may have holes in a bottom wall for airflow, ventilation, and/or drainage of moisture. A drawer liner may have a removable liner to absorb moisture or to prevent items from sliding in the drawer liner. The number of repositionable dividers may vary based on a specific intended application. A drawer liner intended to hold single serve items such as yogurt, juice boxes, cheese sticks, and the like may have three or more repositionable dividers. A drawer liner intended for larger items, such as oranges, apples, and the like, may have optionally a single repositionable divider.

Another aspect of the present invention is a multifunctional refrigerator drawer with a removable drawer liner. The drawer liner may have repositionable dividers. When the dividers are not desired, the drawer liner may be removed from the drawer.

Another aspect of the present invention is a refrigerator drawer liner designed to fit into a drawer while allowing airflow into and out of the drawer. The refrigerator drawer may have holes, also referred to as apertures, air vents, ventilation holes, or ports, for ventilation and/or airflow. The drawer liner may have air vents or ports that align with the refrigerator drawer air vents when the drawer liner is placed in the drawer.

Another aspect of the present invention is a refrigerator drawer liner for segregating a plurality of storage objects in a refrigerator drawer and for transporting storage objects between a secondary location and the refrigerator drawer. The refrigerator drawer liner may have a container body having a receiving space for receiving at least one storage object, a container bottom, at least two side walls, and a positioning slot. The refrigerator drawer liner may have at least one separation plate for variably dividing the receiving space of the container body. The refrigerator drawer liner may have at least one slider so sized and shaped as to operatively connect the at least one separation plate to the container body while allowing the at least one separation plate to be positionally adjusted in the container body and preventing removal of the at least one separation plate from the container body. The at least one separation plate may have a position adjusting handle operatively connected to the at least one separation plate through the positioning slot.

Another aspect of the present invention is a refrigerator with a refrigerator drawer having a refrigerator drawer liner for segregating a plurality of storage objects in the refrigerator drawer and for transporting storage objects between a secondary location and the refrigerator drawer. The refrigerator drawer liner may have a container body having a receiving space for receiving at least one storage object, a container bottom, at least two side walls, and a positioning slot. The refrigerator drawer liner may have at least one separation plate for variably dividing the receiving space of the container body. The at least one separation plate may have at least one slider so sized and shaped as to operatively connect the at least one separation plate to the container body while allowing the at least one separation plate to be positionally adjusted in the container body and preventing removal of the at least one separation plate from the container body. The at least one separation plate may have a position adjusting handle operatively connected to the at least one separation plate through the positioning slot. The refrigerator drawer liner may have at least one airflow hole in at least one side wall of the container body for a passage of airflow from the refrigerator drawer into the refrigerator drawer liner. The refrigerator drawer liner may have at least two separation plates.

Another aspect of the present invention is a multifunctional refrigerator drawer having a refrigerator drawer liner for segregating a plurality of storage objects in the multifunctional refrigerator drawer and for transporting storage objects between a secondary location and the multifunctional refrigerator drawer. The refrigerator drawer liner may have a container body having a receiving space for receiving at least one storage object, a container bottom, at least two side walls, and a positioning slot. The refrigerator drawer liner may have at least one separation plate for variably dividing the receiving space of the container body. The at least one separation plate may have at least one slider so sized and shaped as to operatively connect the at least one separation plate to the container body while allowing the at least one separation plate to be positionally adjusted in the container body and preventing removal of the at least one separation plate from the container body. The at least one separation plate may have a position adjusting handle operatively connected to the at least one separation plate through the positioning slot.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) that are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

FIG. 7A shows a cross-sectional view of the refrigerator drawer liner placed in the refrigerator drawer of FIG. 7 taken along line II-II in FIG. 7 according to an aspect of the drawer liner of the present invention as shown in FIG. 2;

FIG. 7B shows a cross-sectional view of the drawer liner placed in the refrigerator drawer of FIG. 7 taken along line III-III in FIG. 7 according to an aspect of the drawer liner of the present invention as shown in FIG. 2;

FIG. 8A shows an enlarged, exploded cross-section of the portion of the refrigerator drawer liner of FIG. 6A taken along line IV-IV in FIG. 6A and taken in area V in FIG. 7A according to an aspect of the drawer liner of the present invention as shown in FIG. 2;

FIG. 8B shows an enlarged, partially assembled exploded cross-section of the portion of the refrigerator drawer liner of FIG. 6A taken along line IV-IV in FIG. 6A and taken in area V in FIG. 7A according to an aspect of the drawer liner of the present invention as shown in FIG. 2;

FIG. 8C shows an enlarged, partially assembled exploded cross-section of the portion of the refrigerator drawer liner of FIG. 6A taken along line IV-IV in FIG. 6A and taken in area V in FIG. 7A according to an aspect of the drawer liner of the present invention as shown in FIG. 2; and FIG. 8D shows an enlarged, assembled cross-section of the portion of the refrigerator drawer liner of FIG. 6A taken along line IV-IV in FIG. 6A and taken in area V in FIG. 7A according to an aspect of the drawer liner of the present invention as shown in FIG. 2.

DETAILED DESCRIPTION

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Figure 2:
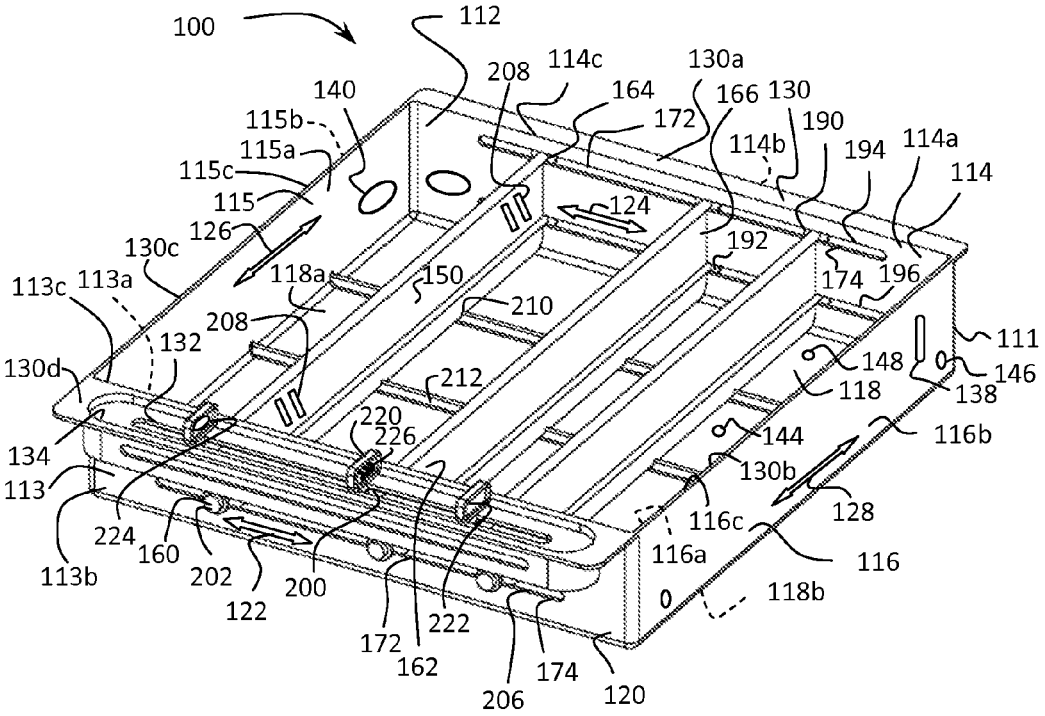
FIG. 2 shows a front, upper left perspective view of a refrigerator drawer liner incorporating an aspect of the present invention.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
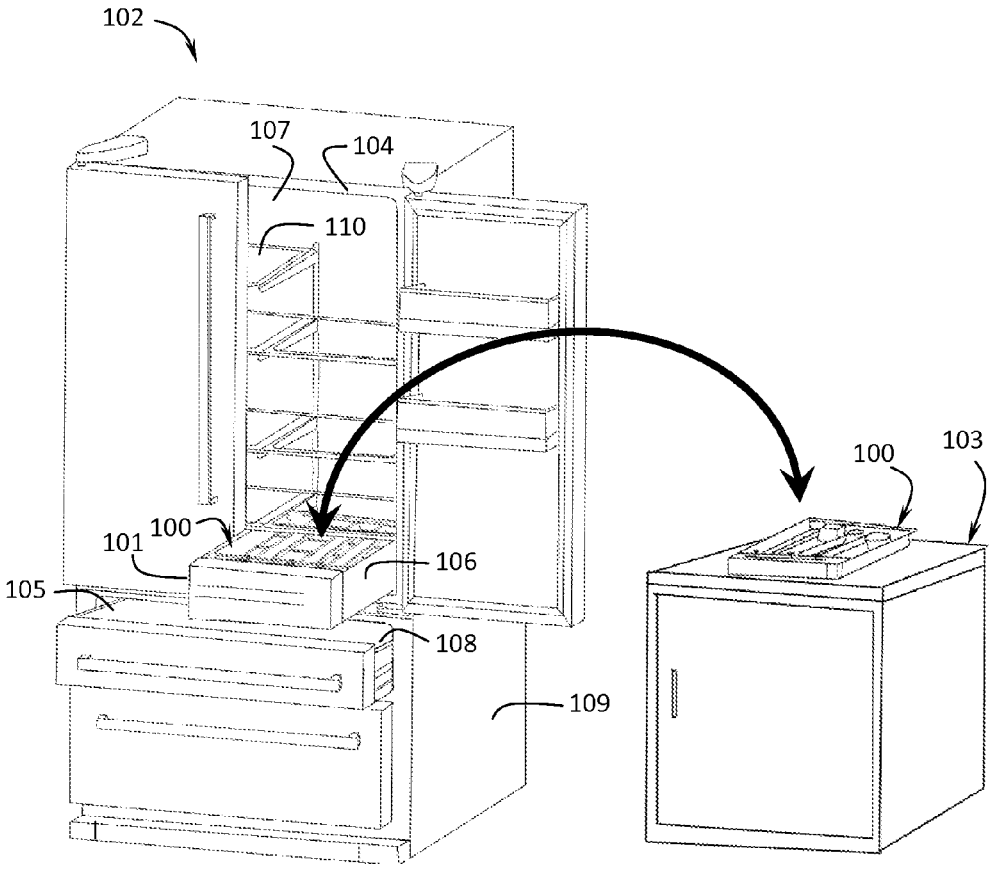
FIG. 1 shows a front, upper left perspective view of a refrigerator having a drawer with a drawer liner and further a front, upper left perspective view of the drawer liner placed on a cabinet according to one aspect of the drawer liner of the present invention.

The present disclosure includes a refrigerator drawer liner 100 for placement in a drawer 101 for a refrigerator 102 as shown in FIG. 1. A refrigerator may include a refrigerating compartment and optionally a freezing compartment. The refrigerator may include a drawer located in the interior of the refrigerating compartment or in the freezing compartment. The refrigerator may optionally include a drawer accessible from the exterior of the refrigerator. FIG. 1 shows a refrigerator 102 having a drawer 101 with a drawer liner 100 and the drawer liner 100 placed on a cabinet 103. The refrigerator 102 has at least one of a refrigerating compartment 104 and a freezing compartment 105. The refrigerator 102 may have at least one drawer 106 accessible from the interior 107 of the refrigerating compartment 104, from the interior 108 of the freezing compartment 105, and/or from the exterior 109 of the refrigerator 102. The refrigerator 102 may have at least one shelf 110 located in the refrigerating compartment 104 or the freezing compartment 105. The drawer liner 100 may be placed inside a drawer 101 and/or placed on a shelf 110 inside the refrigerator. The drawer liner 100 may be removed from the drawer 101 and transported to a secondary location such as a cabinet 103 or a table (not shown) for loading and unloading of drawer liner 100 contents.

FIG. 2 shows a front, upper left perspective view of a refrigerator drawer liner 100. The drawer liner 100 has a container body 111 having a receiving space 112 for receiving at least one storage object (not shown). The drawer liner 100 has a front wall 113, a rear wall 114, a left side wall 115, and a right side wall 116 attached to a liner bottom 118. The liner bottom 118 and each wall 113, 114, 115, 116 has an interior surface 113*a*, 114*a*, 115*a*, 116*a*, 118*a*, facing towards the receiving space 112 and an exterior surface 113*b*, 114*b*, 115*b*, 116*b*, 118*b* facing away from the receiving space 112. The front wall 113, rear wall 114, left side wall 115, and the right side wall 116 each have an upper surface 113*c*, 114*c*, 115*c*, 116*c*. The front wall 113, rear wall 114, left side wall 115, and right side wall 116 may collectively be referred to as side walls 120 or walls 120. The walls 120 form a generally quadrilateral shape where at least longitudinal portions of two opposing walls 113, 114 and/or 115,116 are substantially parallel. Optionally, at least a longitudinal portion 122 of the front wall 113 and at least a longitudinal portion 124 of the rear wall 114 may be substantially parallel. Optionally, a longitudinal portion 126 of the left side wall 115 and a longitudinal portion 128 of the right side wall 116 may be substantially parallel. The term substantially parallel includes walls with a draft angle of up to 10 degrees, a taper, a step offset, a texture, a curvature, or a varying wall thickness. Surfaces that are parallel within +/−10 degrees over 100 mm in length may be considered substantially parallel.

The generally quadrilateral shape may be a rhombus, a square, a rectangle, a diamond, an oblong, a rhomboid, a parallelogram, a trapezoid shape, and the like. Optionally, the drawer liner 100 may have five or more generally vertical walls and have a general shape of a pentagon, a hexagon, an octagon, and the like where at least a portion of at least two opposing walls 113, 114 are substantially parallel in the longitudinal direction. The term generally vertical wall includes a vertical wall, a substantially vertical wall, a wall with a draft angle of up to 10 degrees, a wall with a taper, a wall with a step offset, or a wall with an arcuate curve.

The drawer liner 100, including the walls 120 and liner bottom 118, may be a plastic material including at least one of polystyrene (PS), polycarbonate (PC), high impact polystyrene, polyvinyl chloride (PVC), polyethylene terephrhalate (PETE), polyethylene, high-density polyethylene (HDPE), low density polyethylene (LDPE), polypropylene (PP), polyactide, blends or mixtures of one or more types of plastic material, and the like. The drawer liner 100 may optionally have overmolded or insert molded components or coatings. Portions of the drawer liner 100 may be coated with a rubber, vinyl, neoprene, silicone, and the like. Metal or plastic components (not shown) may be insert molded into the drawer liner 100 to add additional function, strength, cosmetic, and/or decorative features.

The drawer liner 100 as shown in FIG. 2 may have a lip 130 attached to the upper surface of the front wall 113, rear wall 114, left side wall 115, and/or right side wall 116. The lip 130 may be configured to fit into a specific refrigerator drawer, configured to provide rigidity to the drawer liner 100, and/or configured to provide a grip point for handling the drawer liner 100. The width of the lip 130 may vary based on the location on the drawer liner 100. The rear wall lip 130*a* typically may have a width from about 0.1 mm to 25.5 mm. The right side wall lip 130*b* and the left side wall lip 130*c* typically may have a width from about 0.1 mm to about 25.5 mm. The front wall lip 130*d* typically may have a width from about 0.1 mm to about 75 mm. The lip 130 typically may have a thickness from about 0.1 mm to about 40 mm. Alternatively, the drawer liner 100 walls 120 may have one or more edges lacking a lip 130.

The lip 130 may have an elongated positioning slot 132. The elongated positioning slot 132 may be located on the front wall lip 130*d*, the rear wall lip 130*a*, on the right side wall lip 130*b*, or on the left side wall lip 130*c*. The positioning slot 132 may be located on a raised elongated boss (not shown) and/or a recessed elongated channel 134 formed in the lip 130. The positioning slot 132 may have typically a length from about 20 percent to about 95 percent of the length of the wall lip 130 as measured generally across the longitudinal centerline of the positioning slot. The positioning slot may typically have a width from about 1 mm to about 25 mm.

The drawer liner 100, as shown in FIG. 2, typically may have a width inclusive of the lip 130 from about 200 mm to about 1300 mm. The drawer liner 100 typically may have a length inclusive of the lip 130 from about 200 mm to about 600 mm. The drawer liner 100 typically may have a depth inclusive of the lip 130 from about 25 mm to about 300 mm. The walls 120 and liner bottom 118 may have a thickness from about 0.3 mm to about 15 mm. The walls 120 may have a uniform thickness or may have a taper with the walls 120 having a larger wall thickness at the base of the wall 120 where the wall 120 attaches to the liner bottom 118 and a narrower wall thickness near the upper edge of the wall 120.

The drawer liner 100 (FIG. 2) may have one or more apertures 138 in the walls 120. The side walls 120 may have one or more airflow ports 140 to align with an airflow port 142 in the drawer 101 (see FIG. 5). The liner bottom 118 may have one or more drain holes 144. The side walls 120 may have one or more apertures 146 to allow the drawer liner 100 be placed into a dishwasher or washed by hand and permit the water to drain out of the drawer liner 100. The drain holes 144, apertures 138, 146 and airflow ports 140 may be one or more of any known geometric shaped aperture, slots, louvers, and the like. The drain holes 144, apertures 138, 146, and airflow ports 140 may optionally extend to an edge of a wall 120 or the edge of the liner bottom 118. The drain holes 144, apertures 138, 146, and airflow ports 140 may extend across the edge of two walls 120 and/or across the edge of a wall 120 and the liner bottom 118.

The drawer liner bottom 118 and optionally side walls 120 may have one or more apertures 148 or slots for placement of feet or bumpers (not shown) on the exterior of the drawer liner 100. The feet or bumpers (not shown) may be press fit into the liner bottom 118 apertures 148, may be pressed through the apertures 148, may snap into a slot (not shown), or may be screwed into a threaded hole (not shown). The feet or bumpers may be attached the exterior surface 118*b* of the liner bottom 118 or through apertures 148 in the liner bottom 118 using at least one or more of adhesive, glue, mechanical fasteners, through the application of heat, and the like. The feet or bumpers may have an upper part and a lower part which are attached to one another with a snap fit through an aperture 148 in the liner bottom 118. The feet or bumpers may be attached to the liner bottom 118 using screws, threaded fasteners, clips, and the like. Feet or bumpers (not shown) made out of at least one of a rubber, plastic, silicone, elastomeric material, and a non-slip material may aid in preventing the drawer liner 100 from scratching the refrigerator drawer. The feet or bumpers may prevent the drawer liner 100 from sliding inside of a larger refrigerator drawer. The feet or bumpers may allow airflow to pass between the drawer liner 100 and the drawer 101 to improve cooling of the contents of the drawer liner 100. The feet or bumpers may raise the bottom of the drawer liner 100 above the interior surface of the drawer so that any moisture that collects in the drawer liner may drain into the drawer. In the case where multiple drawer liners 100 are placed into a single larger drawer or where the multiple drawer liners 100 are stacked on top of one another, the bumpers may aid in positioning the multiple drawer liners 100. The bumpers may protect the surface of a refrigerator shelf (not shown) or a countertop (not shown) when the drawer liner 100 is removed from the drawer and placed on a refrigerator shelf or a countertop. Optionally, feet or bumpers may be insert molded or overmolded on the drawer liner 100. The drawer liner bottom 118 may have molded ribs (not shown) on the exterior of the liner bottom 118 to serve as supports for the drawer liner 100, serve as feet for the drawer liner 100, or to improve airflow around the drawer liner 100.

Referring to FIG. 2, the drawer liner 100 may have at least one separation plate 150, also referred to as a divider 150, operatively connected between a pair of opposing walls 113, 114 or 115, 116 in the container body 111. The separation plate 150 may be stationary (not shown) or may be repositionable, also referred to as positionally adjustable and/or movable, in the container body 111. The separation plate 150 may have at least a first slider 160 located on the first end 162 of the separation plate 150 and at least a second slider 164 located on the second end 166 of the separation plate 150. The first slider 160 may fit into a longitudinal slot 170 located in front wall 113. The second slider 164 may fit into a longitudinal slot 172 located in the rear wall 114. The longitudinal slot 170, 172 may be a channel, a groove, a raised fillet, a rib, a fillister, a through hole, an aperture, a passageway, and the like. The slot 170, 172 may have a smooth edge 174 or may have a contoured edge with notches, arcuate sections, ridges, indents, or other contours (not shown) to aid in the positioning of the separation plate 150.

Alternatively, the sliders 160, 164 may extend through the slot 170, 172, be operatively connected through the slot 170, 172, ride in the slot 170, 172, or hook into the slot 170, 172 (not shown). Alternatively, the at least one separation plate 150 may be operatively connected between a longitudinal slot (not shown) in the left side wall 115 and a longitudinal slot (not shown) in the right side wall 116 (not shown). Optionally, the separation plate 150 may have an upper second slider 190 and a lower second slider 192 that may be operatively connected to an upper longitudinal slot 194 and a lower longitudinal slot 196, respectively, in the rear wall. Optionally, the separation plate 150 may have an upper first slider 200 and a lower first slider 202 that may be operatively connected to an upper longitudinal slot 204 (FIG. 7B) and a lower longitudinal slot 206, respectfully, in the front wall. Alternatively, the at least one separation plate 150 may have a pair of sliders 190, 192 on one end of the separation plate 150 and a single slider 200 on the other end of the separation plate 150 (not shown).

There may be a single separation plate 150, two separation plates 150, three separation plates 150, or a plurality of separation plates 150. An individual separation plate 150 may be stationary and permanently attached to the drawer liner 100. There may be a mixture of stationary separation plates (not shown) and repositionable separation plates 150. Generally, the separation plate 150 may be substantially rigid. However, in some cases the separation plate 150 may be flexible and made out of a material such as silicone or a silicone blend. The separation plate 150 may be at least one of a plastic material and metal. The separation plate 150 may be assembled from one or more components. The separation plate 150 may optionally have overmolded or insert molded components or coatings. Portions of the separation plate 150 may be coated with at least one of an elastomeric material, paint, plating, and the like. Metal or plastic components (not shown) may be insert molded into the separation plate 150 to add additional function, strength, attachment mounting points, cosmetic, and/or decorative features.

The separation plate 150 typically may have a height from about 25 mm to about 300 mm. The separation plate 150 typically may have a length from about 100 mm to about 600 mm. The separation plate 150 typically may have a width from about 0.2 mm to about 20 mm. The separation plate 150 may have a uniform thickness, a varying thickness, or may have a taper with the separation plate 150 having a larger wall thickness at the base of the separation plate 150 and a narrower wall thickness near the upper edge of the separation plate 150. When the drawer liner 100 has multiple separation plates 150, the individual separation plates 150 may vary in size, shape, material, and structural construction. The separation plate 150 may have through holes (not shown) or apertures in the longitudinal direction for the insertion of a rod (not shown) to support the separation plate 150 in the drawer liner 100.

The separation plate 150 (FIG. 2) may have one or more ventilation apertures 208 in the separation plate 150 for air movement. The separation plate 150 may have a channel 210, a notch, a tab, or the like for positioning the separation plate 150 in the drawer liner 100. The drawer liner 100 bottom interior surface 118*a* may have one or more raised rails 212, recessed channels (not shown), or a combination of raises rails 212 and recessed channels, which align with the separation plate 150 channel 210. The one or more bottom liner rails 212 and the one or more separation plate channels may permit the separation plate 150 to slide across the width of the drawer liner 100 while maintaining the alignment of the separation plate 150 in the drawer liner 100.

Figure 3:
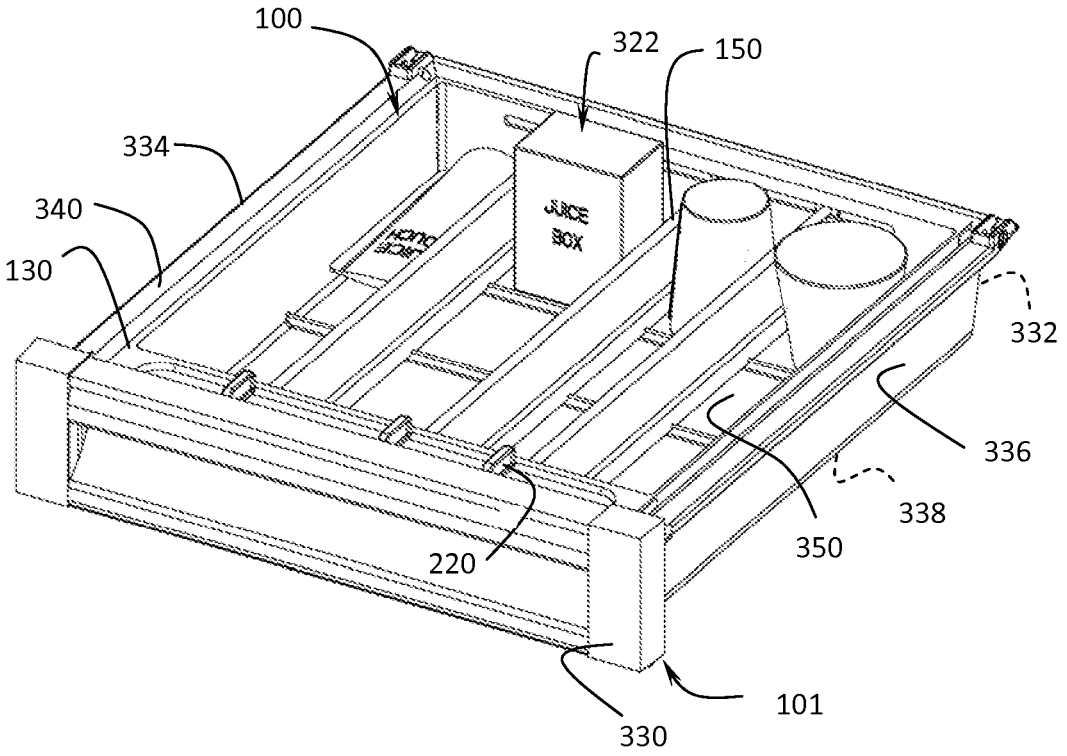
FIG. 3 shows a front, upper left perspective view of a refrigerator drawer liner where the drawer liner is placed in a refrigerator drawer and further where storage objects are placed in the drawer liner according to one aspect of the drawer liner of the present invention as shown in FIG. 2.

The at least one repositionable separation plate 150 may have a positioning handle 220 operatively connected through the repositioning longitudinal slot 132 in the lip 130. The positioning handle 220 may be formed from a plastic material. The positioning handle 220 alternatively may be made out of metal. The positioning handle 220 may optionally have overmolded or insert molded components or coatings. Portions of the positioning handle 220 may be coated with one or more of an elastomeric material, paint, plating, and the like. Metal or plastic components (not shown) may be insert molded into the positioning handle 220 to add additional function, strength, attachment mounting points, cosmetic, and/or decorative features. The positioning handle may have a recessed surface 222 and/or an aperture 224 through the handle 220. A texture or a grip pattern 226 may be formed into the surface of the positioning handle 220. The positioning handle 220 may have a generally rectangular or oval shape with alternative shapes also being suitable. The positioning handle 220 may have a length typically between about 5 mm to about 40 mm. The positioning handle 220 may have a height typically between about 5 mm to about 40 mm. The positioning handle 220 may have a width typically between about 1 mm to about 15 mm. FIG. 3 shows a front, upper left perspective view of a refrigerator drawer liner 100 where the drawer liner 100 is placed in a refrigerator drawer 101 and further where storage objects 322 are placed in the drawer liner 100. The refrigerator drawer 101 has a drawer front wall 330, a drawer rear wall 332, a drawer left side wall 334, a right side wall 336, and a drawer bottom 338. The lip 130 of the drawer insert 100 may touch the drawer walls 330, 332, 334, 336, may cover the upper edge 340 of the drawer walls 330, 332, 334, 336, and/or may rest on the upper edge 340 of the drawer walls 330, 332, 334, 336. Optionally, the drawer liner 100 may be smaller than the drawer 101 such that there is a gap between the drawer liner 100 lip 130 and the drawer walls 330, 332, 334, 336. Further, the drawer liner 100 may be narrower than the drawer 101 interior width and/or shorter than the drawer 101 interior length. In this case, the drawer liner 100 may be placed in multiple positions within the drawer 101. When the drawer 101 depth is greater than the depth of the drawer liner 100, multiple drawer liners may be stacked inside a single drawer. When the width of the drawer 101 is greater than the width of the drawer liner 100, multiple drawer liners may be placed next to one another in the drawer 101. Drawer liners 100 may be available in assorted sizes (various depth, width, and length) to allow for mixing and matching drawer liners 100 in a specific drawer 101 to best utilize the space in the drawer.

The storage objects 322 placed in the drawer liner 100 shown in FIG. 3 may including individual packages of food or drink such as juice boxes, yogurt, pudding, fruit, cheese, vegetables, and the like. The separation plates 150 may be repositioned in the drawer liner 100 to separate and organize the small storage objects 322. When there are multiple separation plates 150, the separation plates 150 may be adjusted as desired using the positioning handles 220. The positioning handle 220 may be repositioned in the positioning slot 132 (FIG. 2) to change the position of the separation plates 150. When fewer separation plates 150 are desired, two or more separation plates 150 may be slid together to form a single wider separation plate 150. Thus, a drawer liner 100 having four storage areas 350 may have three separation plates 150 distributed in the drawer liner 100. When two of the separation plates 150 are slid close together, the drawer liner 100 would now have three storage areas 350 instead of four storage areas 350. When the three separation plates 150 are slid close together, the drawer liner will have two larger storage areas 350 instead of the four smaller storage areas 350.

Figure 4:
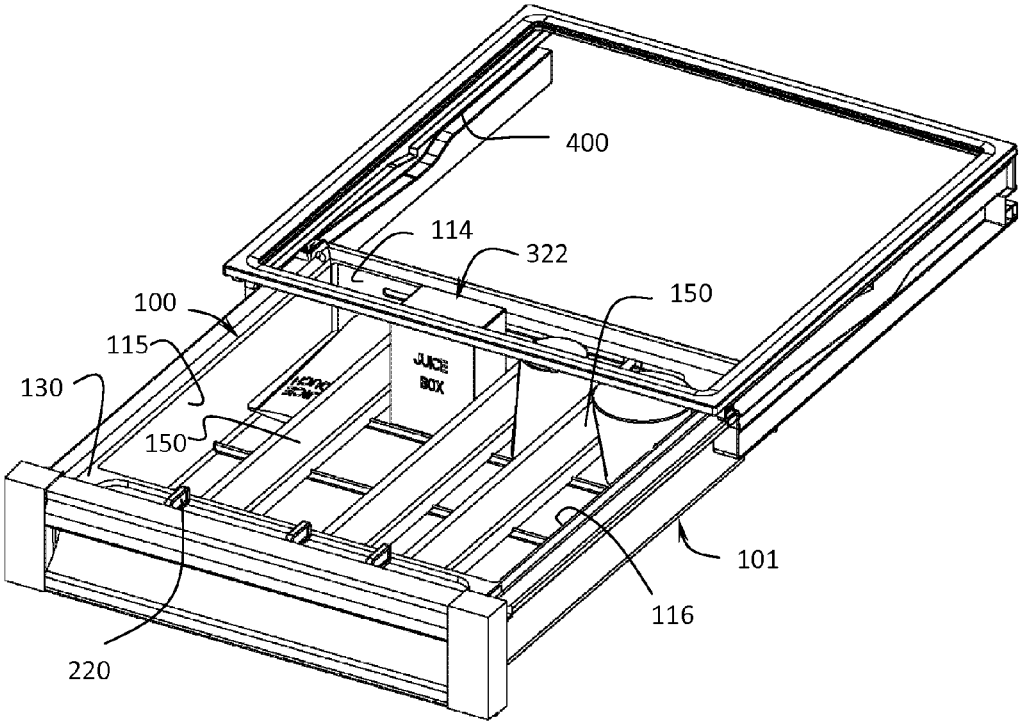
FIG. 4 shows a front, upper left perspective view of a refrigerator drawer partially slid into a pair of refrigerator drawer support rails, the drawer liner is located in the refrigerator drawer, and where storage objects are located in the drawer liner according to one aspect of the drawer liner of the present invention as shown in FIG. 2.

FIG. 4 shows a front, upper left perspective view of a refrigerator drawer 101 partially slid into a pair of refrigerator drawer support rails 400. The drawer liner 100 is located in the refrigerator drawer 101. Storage objects 322 are located in the drawer liner 100. The drawer liner 100 may be removed from the drawer 101 without removing the drawer 101 from the drawer support rails 400. A user may grab the repositioning handles 220 to aid in the removal of the drawer liner 100 from the drawer 101. The user may alternatively grab the separation plates 150 or grab the drawer liner 100 lip 130 to aid in the removal of the drawer liner 100 from the drawer 101. The drawer liner 100 may optionally have additional grab points or handles (not shown) for aiding in the removal of the drawer liner 100 from the drawer 101. The drawer liner 100 may be lifted vertically out of the drawer 101 or the front of the drawer liner 100 may be rotated out of the drawer 101. The height of the sides 114, 115, 116 of the drawer liner 100 may be tapered, angled, or stepped (not shown) in order to allow the drawer liner 100 to be rotated out of the drawer 101 when the drawer 101 is partially inserted into the drawer support rails 400.

Figure 5:
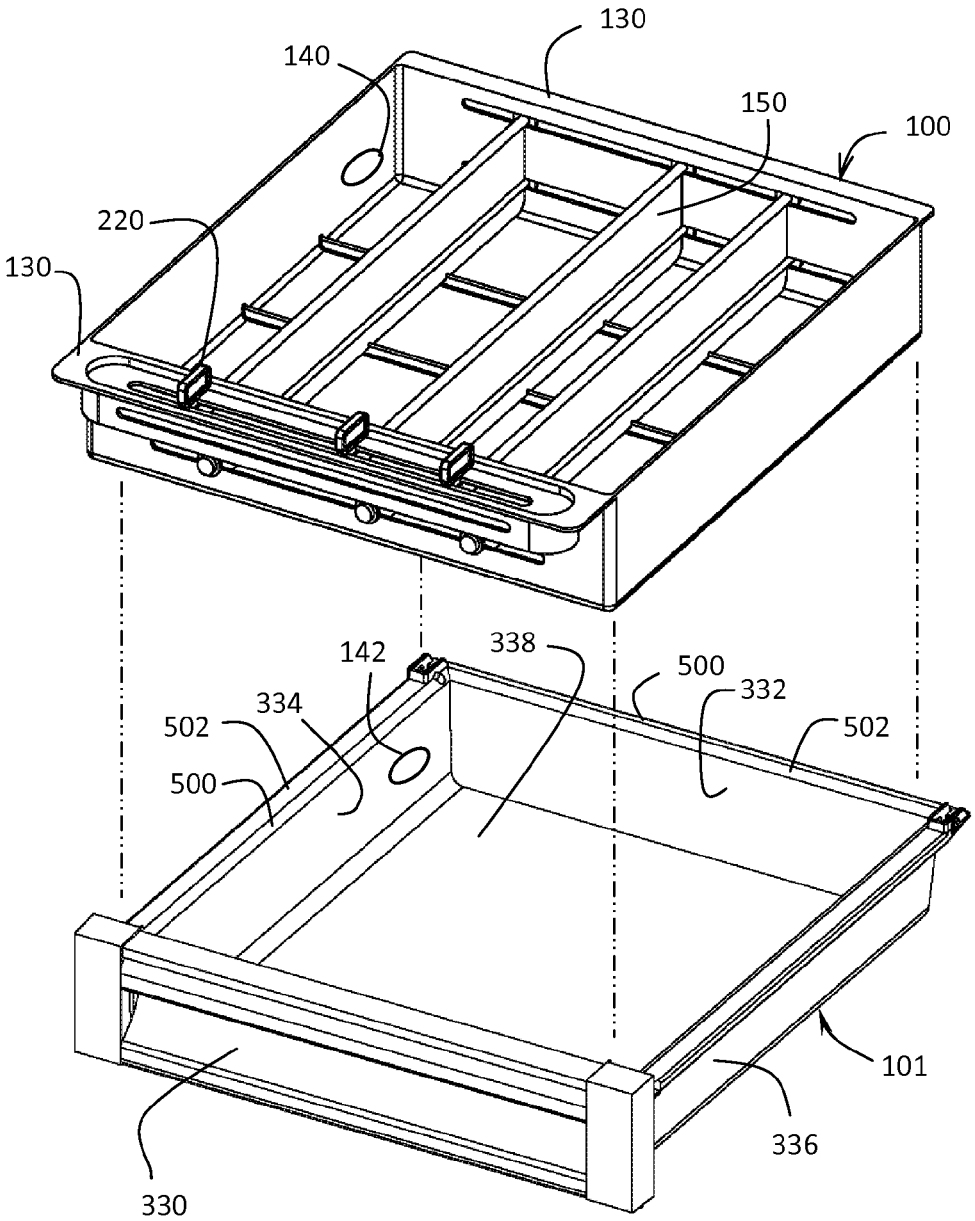
FIG. 5 shows a front, upper left perspective exploded view of the refrigerator drawer liner and the refrigerator drawer showing the alignment of the drawer liner in the drawer according to one aspect of the drawer liner of the present invention as shown in FIG. 4.

FIG. 5 shows a front, upper left perspective exploded view of the refrigerator drawer liner 100 and the refrigerator drawer 101 showing the alignment of the drawer liner 100 in the drawer 101 according to one aspect of the present invention. The drawer liner 100 may have one or more airflow ports 140 that may align with an airflow port 142 in the drawer 101 when the drawer liner 100 is placed into the drawer 101. The drawer 101 may have a ledge 500 on the upper portion of one or more drawer walls 330, 332, 334, 336 to support the drawer liner 100 lip 130. Alternatively, the drawer liner 100 may fit completely within the drawer 101. The drawer liner 100 lip 130 may rest on one or more of the upper edge 502 of the drawer 101 walls 330, 332, 334, 336.

Figure 6A:
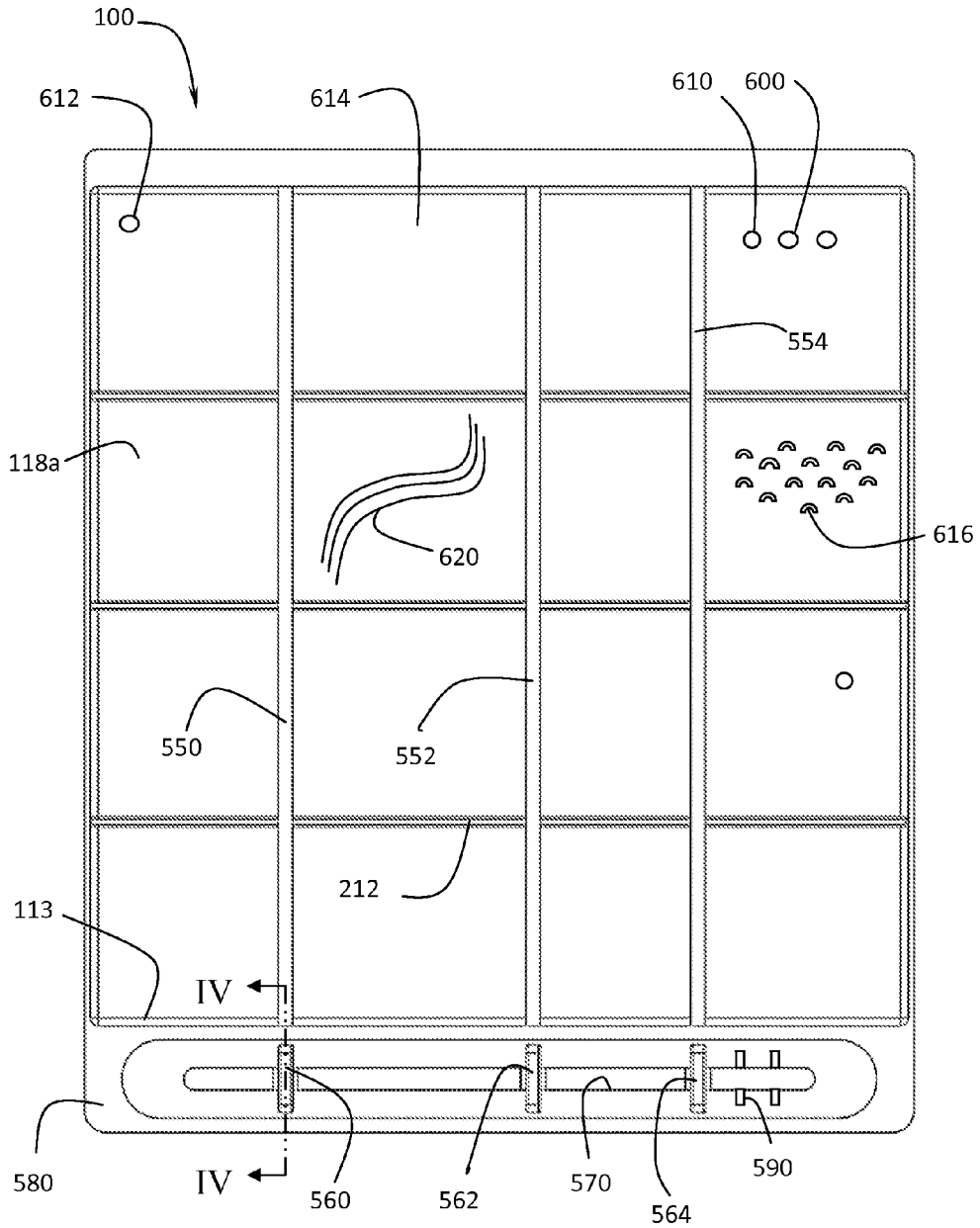
FIG. 6A shows a top view of the refrigerator drawer liner according to an aspect of the present invention as shown in FIG. 2.

FIG. 6A shows a top view of the refrigerator drawer liner 100 as shown in FIG. 2. The drawer liner 100 may have one or more separation plates 550, 552, 554 which may be repositionable within the drawer liner 100. Each repositionable separation plate 550, 552, 554 has a positioning handle 560, 562, 564 which slides in an elongated positioning slot 570 located on the wide lip 580 attached to the front wall 113 of the drawer liner 100. The elongated positioning slot 570 may have one or more positioning notches 590 to aid in the positioning of the separation plates 550. The positioning notches 590 may be recessed notches, raised pads, textured areas, and the like to retain the separation plates 550 in a specific location. The positioning handle 560 may have an insert molded magnet (not shown) and a metal strip located near the positioning slot 570. The magnet in the positioning handle 560 may be used to position the separation plate 550 in the drawer liner 100. The magnet may hold the separation plate 550 in the desired position without the use of a mechanical or fictional engagement. The positioning handle 560 may be held in position at the location of the positioning notch 590 through a mechanical engagement, a frictional engagement, magnetic attachment, or may be held in between two positioning notches 590. Alternatively, the positioning handles 560 may move freely along the positioning slot 570.

As shown in FIG. 6A, the interior bottom surface 118*a* of the drawer liner 100 may have one or more liner rails 212. The separation plates 550 may have channels 210 that slide along the liner rails 212 when the separation plates 550 are repositioned. The interior bottom surface 118*a* may have one or more drain holes 600, apertures for airflow 610, and/or apertures 612 for mounting feet or bumpers (not shown). The interior bottom surface 118*a* may optionally have a smooth surface 614, a textured surface 616, and/or a patterned contoured surface 620.

Figure 6B:
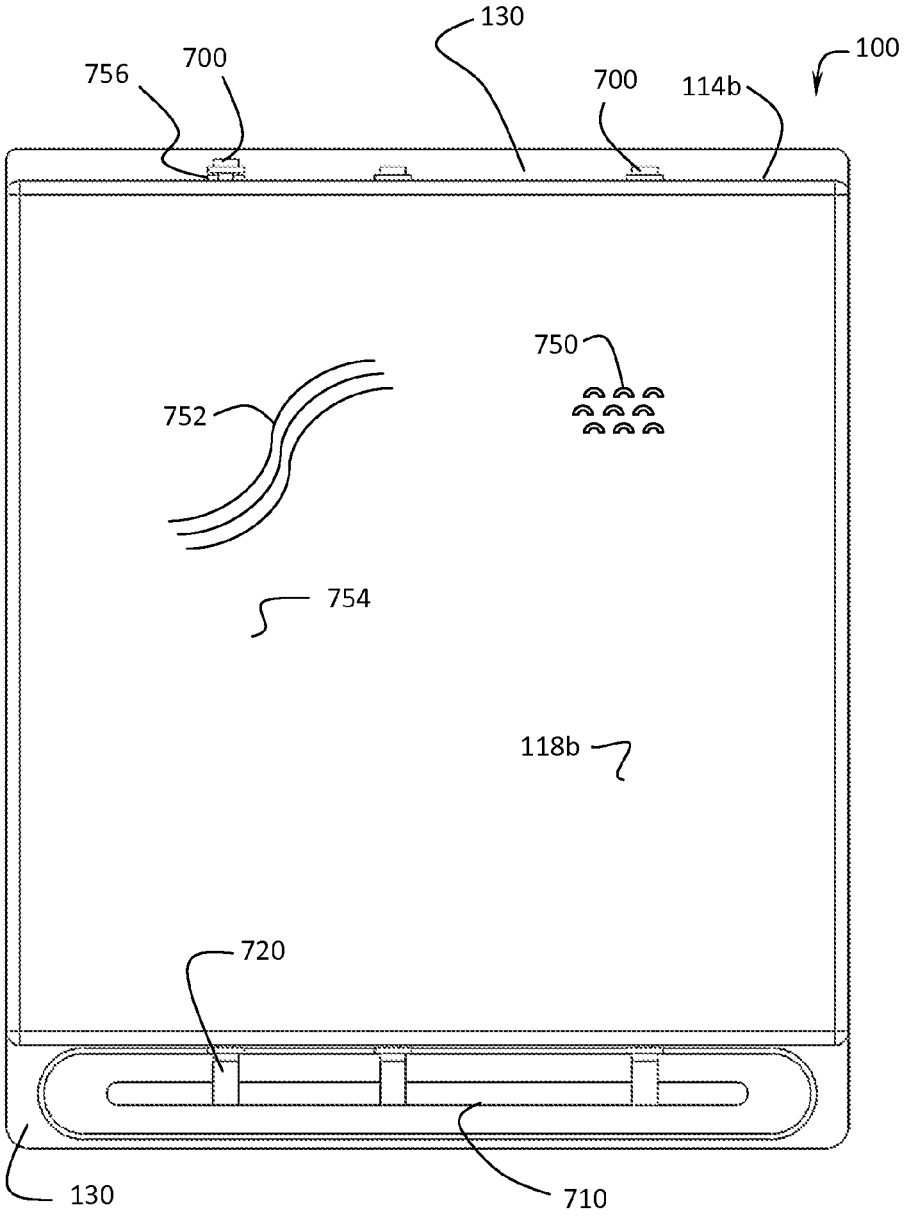
FIG. 6B shows a bottom view of the refrigerator drawer liner according to an aspect of the present invention as shown in FIG. 2.

FIG. 6B shows a bottom view of the refrigerator drawer liner 100 as shown in FIG. 2. The exterior drawer liner 100 bottom surface 118*b*, extended lip 130 of the drawer liner 100, the rear separation plate sliders 700, the elongated positioning slot 710, and the separation plate positioning handle attachments 720 are shown. The exterior bottom surface 118*b* may have a texture 750, a contour 752, and/or a generally smooth surface 754. The texture 750 or contour 752 on the exterior bottom surface 118*b* may match with the drawer 101 inner bottom surface 338 (FIG. 5). The one or more sliders 700 may be positioned adjacent the drawer liner 100 wall exterior surface 114*b*. Alternatively, a washer 756, a shim, low friction material, or the like may be positioned between the slider 700 and the drawer liner 100 wall exterior surface 114*b*.

Figure 7:
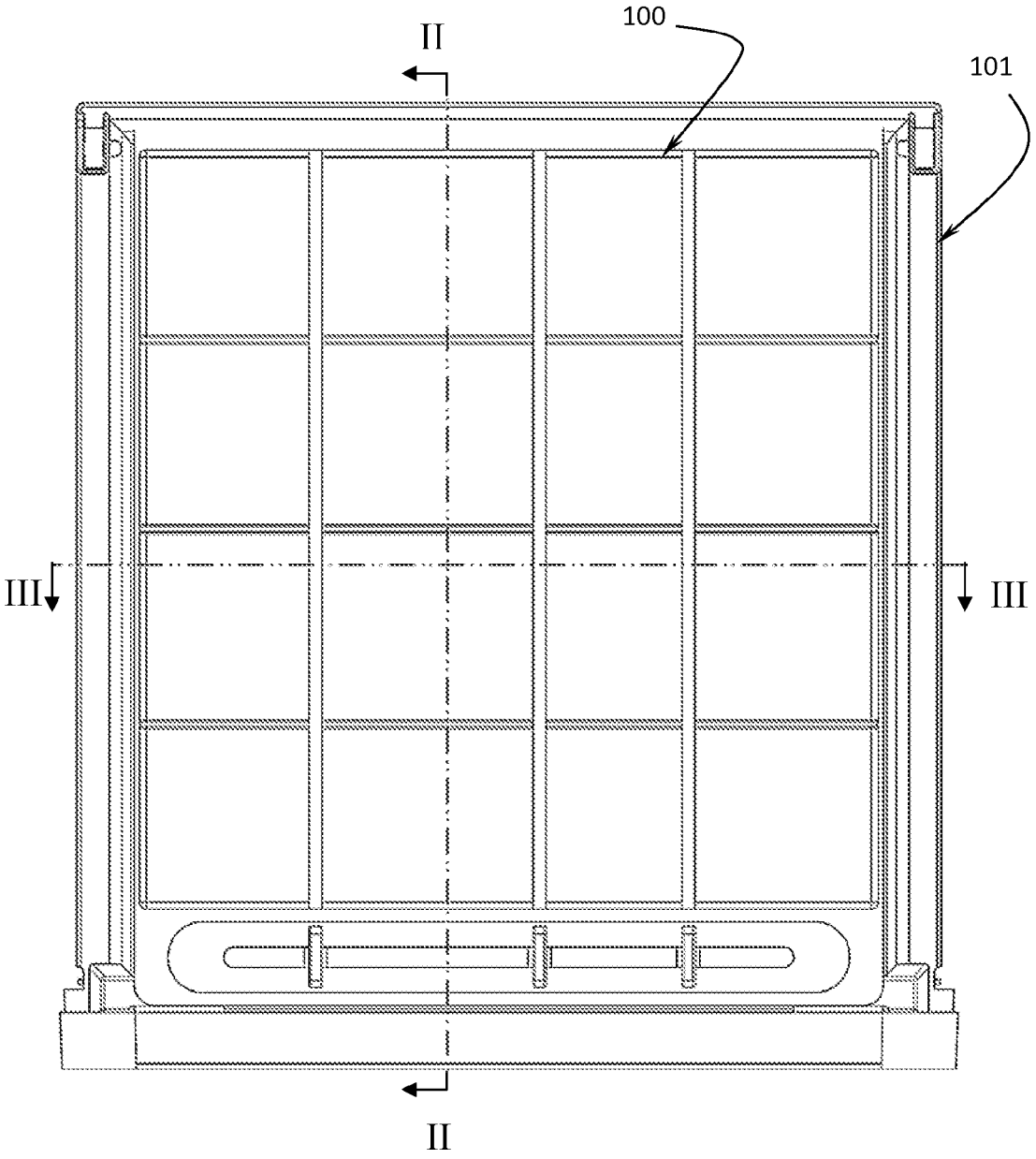
FIG. 7 shows a top view of the drawer liner placed in the refrigerator drawer with the storage objects removed as shown in FIG. 3 according to an aspect of the present invention as shown in FIG. 2.

FIG. 7 shows a top view of the drawer liner 100 placed in the refrigerator drawer 101 with the storage objects 322 removed from the drawer liner 100. FIG. 7A shows a cross-sectional view of FIG. 7 taken along line II-II. The drawer front wall 330, drawer bottom 338, and drawer rear wall 332 are shown. The drawer liner 100 is shown with the liner bottom 118 positioned on top of the drawer bottom 338. The liner bottom 118 may be positioned above the drawer bottom 338 if feet or bumpers (not shown) are attached to the liner bottom 118. The liner rear wall lip 130*a* is shown abutted to the drawer rear wall. Alternatively, the lip 130*a* may overlap the drawer wall 332 upper edge 760. The liner lip 130*a* may rest on a drawer lip 762 and/or a recessed ledge (not shown) near the edge of the drawer wall 332 or on a drawer lip 762. There may be a gap between the drawer liner lip 130*a* and the drawer wall 332.

A separation plate 150 (FIG. 7A) is shown with a separation channel 210 abutted to a liner rail 212 on the liner bottom 118. There may be one, two, three, or a plurality of channels 210 in a separation plate 150. The channels may be a notch, a "T" shaped slot, an "L" shaped slot, and the like. The rails 212 may have a rectangular cross-section, a rounded rectangular cross-section, "T" shaped cross-section, an "L" shaped cross-section, and the like. Alternatively, the liner bottom 118 may have a recessed channel and the separation plate 150 may have a tab, "L" shaped projection, a "T" shaped projection, and the like. The liner bottom 118 may alternatively have a smooth surface where the separation plate 150 does not have an alignment feature on the lower edge of the separation plate 150. The rails 212 may be formed as part of the drawer liner 100 or the drawer liner 100 bottom 118 may have a channel (not shown) for the insertion of a separate rail (not shown). The separate rail (not shown) may be made out of low friction material such as a thermoplastic polymer, acetal, fluoropolymer, polytetraflouroethylene (PTFE), or similar resin material.

The separation plate 150 (FIG. 7A) is shown with an upper second slider 190 and a lower second slider 192 operatively connected through the liner rear wall 114. An upper first slider 200 and a lower first slider 202 are operatively connected through the liner front wall 113. The area V is shown enlarged in FIGS. 8A-8D. The upper first slider 200 may be operatively connected to the positioning handle 220. Alternatively, the positioning handle 220 may be directly connected (not shown) to the separation plate 150. The separation plate 150 may have one or more through holes 770 in the longitudinal direction for the insertion of a support rod (not shown) to support the separation plate 150 in the drawer liner 100. If a rod is used to support the separation plate 150, the second end of the rod may be attached to a separation plate slider 190. The first end of rod may be inserted through a wall longitudinal slot 172, through a through hole 770 in the separation plate 150, and then through a second wall longitudinal slot 170. A second slider 200 may be attached to the first end of the support rod. Other means of attaching the separation plate 150 to the drawer liner 100 may de used. Examples of alternative attachment means are the separation plate 150 having an extended lip or a "J" shaped lip (not shown) to attach to and/or wrap around the upper edge of the drawer liner 100. The upper edge of the drawer liner 100 may have a channel (not shown) for retaining a portion of the separation plate 150. The separation plate 150 may have a recessed hole (not shown) in the end 162 of the separation plate 150. The separation plate 150 may be placed into the drawer liner 100 and a slider 190 may be partially inserted through a wall longitudinal slot 172 and operatively connected to the recessed hole in the separation plate. The slider 190 may have a snap fit connection, a threaded connection, a press-fit connection, an adhesive connection, a weld connection, and the like to the separation plate 150. The recessed hole in the separation plate 150 may be a though hole in the longitudinal direction or may be a hole that is typically between 2 mm and 20 mm deep, more typically between 4 mm and 15 mm deep, and most typically between 5 mm and 8 mm deep. Alternatively, the separation plate 150 may have a snap hole (not shown) through the thickness of the separation plate where the snap hole is round, oval, rectangular, "H" shaped, or the like. The slider 190 may have one or more legs, a bifurcated clip, one or more "L" shaped legs, or the like (not shown). The legs (not shown) on the slider 190 may have a snap fit connection around the edge of the separation plate 150. The legs (not shown) of the slider 190 may be inserted through the longitudinal slot 172 and snapped around the edge of the separation plate 150 with the ends of the legs operatively connecting in or through the snap hole in the separation plate 150. Alternatively, the separation plate 150 may have one or more tabs (not shown) on the edges of the separation plate 150 that may be inserted through the longitudinal wall slot 172 and a slider 190 attached to the end of the separation plate 150 tab.

FIG. 7B shows a cross-sectional view of the drawer liner 100 placed in the refrigerator drawer 101 of FIG. 7 taken along line III-III in FIG. 7. The drawer liner 100 is positioned in the drawer 101. The separation plates 550, 552, 554 may be repositioned in the drawer liner 100 by sliding the separation plate 550 along the longitudinal slot 204, 206. Alternatively, the separation plate 550 may be repositioned by sliding the positioning handle 220 along the positioning slot (not shown). When fewer separation plates 550 are desired in the drawer liner 100, adjacent separation plates 550, 552 may be positioned closely adjacent to one another. This increases the space between the remaining separation plates 550 and reduces the number of divided areas in the drawer liner 100.

FIG. 8A shows an enlarged, exploded cross-section of the portion of the refrigerator drawer liner 100 of FIG. 6A taken along line IV-IV in FIG. 6A and taken in area V in FIG. 7A. The separation plate 150 is shown positioned in the drawer liner 100 with the first end 162 of the separation plate 150 adjacent the interior surface 113*a* of the drawer liner 100 front wall 113. The separation plate 150 may have through holes 770*a*, 770*b* or recessed holes (not shown) in the longitudinal direction for the insertion of a rod (not shown) or the insertion of attachment means. The upper through hole 770*a* may be aligned with the front wall upper longitudinal slot 204. The lower through hole 770*b* may be aligned with the front wall lower longitudinal slot 206. The front wall 113 of the drawer liner 100 is shown having a lip 130*d* having a recessed channel 134 for the positioning slot 132. The lower slider 202 is shown with a round leg 772 for a press-fit connection through the lower longitudinal slot 206 and into the lower through hole 770*b* in the separation plate 150. The upper slider 200 is shown with a "C" shaped recess 774 for the attachment of the positioning handle 220. The upper slider 200 may have a round leg 776 for a press-fit connection through the upper longitudinal slot 204 and into the upper through hole 770*a* in the separation plate 150. The positioning handle 220 is shown with a snap-fit leg 780 for operatively connecting through the positioning slot 132 and mating with the "C" shaped recess 774 in the upper slider 200. Alternatively, the upper slider 200 and/or the lower slider 202 may have a threaded boss, a spline shaft, a barbed projection, a bifurcated clip projection, a rectangular boss, and the like for attachment to the separation plate 150. Alternatively, the slider 200, 202 may have a slider attachment hole (not shown) perpendicular to the sliding surface 782 on the slider 200, 202. The slider 200, 202 may be placed adjacent the exterior surface 113*b* of the drawer liner 100 with the centerline of the slider attachment hole (not shown) aligned with the through hole 770*a*, 770*b* in the separation plate 150 and aligned with the longitudinal slot 204, 206. A pin, screw, rod, clip, or the like may be inserted through the slider 200, 202 attachment hole, through the longitudinal slot 204, 206 and into the separation plate 150.

FIG. 8B shows the upper slider 200 positioned with the "C" recess 774 aligned with the positioning slot 132. The slider 200 round leg 776 is inserted into the longitudinal slot 204 and into the through hole 770*a* in the separation plate 150. FIG. 8C shows the snap-fit leg 780 of the positioning handle 220 inserted through the positioning slot 132 and mated with the "C" shaped recess 774 in the upper slider 200. FIG. 8D shows the lower slider 202 aligned with the lower longitudinal slot 206 with the round leg 772 inserted through the lower longitudinal slot 206 and into the through hole 770*b* in the separation plate 150.

The above description is considered that of the preferred embodiment only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A refrigerator drawer liner for segregating a plurality of storage objects in a refrigerator drawer and for transporting storage objects between a secondary location and the refrigerator drawer, the refrigerator drawer liner comprising:

a container body having a receiving space for receiving at least one storage object, a container bottom, at least two side walls, a lip connected to one of the at least two side walls, and a positioning slot located on the lip;

at least one separation plate for variably dividing the receiving space of the container body;

at least one slider so sized and shaped as to operatively connect the at least one separation plate to the container body while allowing the at least one separation plate to be positionally adjusted in the container body and preventing removal of the at least one separation plate from the container body; and a position adjusting handle operatively connected to the at least one separation plate through the positioning slot.

2. The refrigerator drawer liner of claim 1, wherein the refrigerator drawer liner has at least two separation plates.

3. The refrigerator drawer liner of claim 1, wherein the container body of the refrigerator drawer liner is formed at least in part out of polystyrene, high impact polystyrene, or polycarbonate.

4. The refrigerator drawer liner of claim 1, wherein the container body has at least one airflow hole in at least one side wall for a passage of airflow from the refrigerator drawer into the refrigerator drawer liner.

5. The refrigerator drawer liner of claim 1, wherein the position adjusting handle is a grip point for a user to remove the refrigerator drawer liner from the refrigerator drawer.

6. A refrigerator with a refrigerator drawer having a refrigerator drawer liner for segregating a plurality of storage objects in the refrigerator drawer and for transporting storage objects between a secondary location and the refrigerator drawer, the refrigerator drawer liner comprising:

a container body having a receiving space for receiving at least one storage object, a container bottom, at least two side walls, a lip connected to one of the at least two side walls, and a positioning slot located on the lip;

at least one separation plate for variably dividing the receiving space of the container body;

at least one slider so sized and shaped as to operatively connect the at least one separation plate to the container body while allowing the at least one separation plate to be positionally adjusted in the container body and preventing removal of the at least one separation plate from the container body; and a position adjusting handle operatively connected to the at least one separation plate through the positioning slot.

7. The refrigerator of claim 6, wherein the refrigerator drawer liner has at least two separation plates.

8. The refrigerator of claim 6, wherein the container body of the refrigerator drawer liner is formed at least in part out of polystyrene, high impact polystyrene, or polycarbonate.

9. The refrigerator of claim 6, wherein the container body has at least one airflow hole in at least one side wall for a passage of airflow from the refrigerator drawer into the refrigerator drawer liner.

10. The refrigerator of claim 6, wherein the position adjusting handle is a grip point for a user to remove the refrigerator drawer liner from the refrigerator drawer.

11. A multifunctional refrigerator drawer having a refrigerator drawer liner for segregating a plurality of storage objects in the multifunctional refrigerator drawer and for transporting storage objects between a secondary location and the multifunctional refrigerator drawer, the refrigerator drawer liner comprising:

a container body having a receiving space for receiving at least one storage object, a container bottom, at least two side walls, a lip connected to one of the at least two side walls, and a positioning slot located on the lip;

at least one separation plate for variably dividing the receiving space of the container body;

at least one slider so sized and shaped as to operatively connect the at least one separation plate to the container body while allowing the at least one separation plate to be positionally adjusted in the container body and preventing removal of the at least one separation plate from the container body; and a position adjusting handle operatively connected to the at least one separation plate through the positioning slot.

12. The multifunctional refrigerator drawer of claim 11, wherein the container body has at least one airflow hole in at least one side wall for a passage of airflow from the multifunctional refrigerator drawer into the refrigerator drawer liner.

13. The multifunctional refrigerator drawer of claim 11, wherein the refrigerator drawer liner is removable from the multifunctional refrigerator drawer.

14. The multifunctional refrigerator drawer of claim 11, wherein the container body of the refrigerator drawer liner is formed at least in part out of polystyrene, high impact polystyrene, or polycarbonate.

15. The multifunctional refrigerator drawer of claim 11, wherein the refrigerator drawer liner has at least two separation plates.

16. The multifunctional refrigerator drawer of claim 11, wherein the position adjusting handle is a grip point for a user to remove the refrigerator drawer liner from the multifunctional refrigerator drawer.

* * * * *